US009051103B2

(12) United States Patent
Chiang

(10) Patent No.: US 9,051,103 B2
(45) Date of Patent: Jun. 9, 2015

(54) SOCKET HOLDER

(71) Applicant: Kuo-Chin Chiang, Taichung (TW)

(72) Inventor: Kuo-Chin Chiang, Taichung (TW)

( * ) Notice: Subject to any disclaimer, the term of this patent is extended or adjusted under 35 U.S.C. 154(b) by 44 days.

(21) Appl. No.: 13/958,677

(22) Filed: Aug. 5, 2013

(65) Prior Publication Data

US 2015/0034514 A1 Feb. 5, 2015

(51) Int. Cl.
*B65D 73/00* (2006.01)
*B25H 3/00* (2006.01)

(52) U.S. Cl.
CPC ..... *B65D 73/0064* (2013.01); *B25H 3/003* (2013.01)

(58) Field of Classification Search
CPC ..... B65D 73/0064; B25H 3/04; B25H 3/00
USPC ..... 206/378, 493, 806; 211/70.6
See application file for complete search history.

(56) References Cited

U.S. PATENT DOCUMENTS

| | | | | |
|---|---|---|---|---|
| 6,032,797 | A * | 3/2000 | Kao | 206/378 |
| 6,450,338 | B1 * | 9/2002 | Chen | 206/378 |
| 2005/0126943 | A1 * | 6/2005 | Liu | 206/378 |
| 2006/0254940 | A1 * | 11/2006 | Mu et al. | 206/378 |

FOREIGN PATENT DOCUMENTS

EP 1655112 A1 * 5/2006

* cited by examiner

*Primary Examiner* — Bryon Gehman
(74) *Attorney, Agent, or Firm* — Alan D. Kamrath; Kamrath IP Lawfirm, P.A.

(57) ABSTRACT

A socket holder includes at least one holder body, at least one elastomer fixing device, and at least one socket. The at least one socket has an interior provided with a mounting hole mounted on the at least one holder body. The mounting hole has at least one groove. The at least one holder body is made of hard material. The at least one elastomer fixing device is made of soft material and has at least one arcuate protrusion protruding outward from the at least one holder body and locked in the at least one groove of the at least one socket. The at least one arcuate protrusion is deformed slightly and is allowed to enter the mounting hole of the at least one socket. Thus, the at least one elastomer fixing device is formed with the at least one arcuate protrusion to replace the conventional steel ball.

5 Claims, 10 Drawing Sheets

SOCKET HOLDER

BACKGROUND OF THE INVENTION

1. Field of the Invention

The present invention relates to a holder and, more particularly, to a socket holder for supporting and positioning a socket.

2. Description of the Related Art

A conventional socket holder in accordance with the prior art shown in FIGS. 13 and 14 comprises a holder body 50 having a through hole 51, two steel balls "R" mounted in the through hole 51 of the holder body 50, and a spring "S" mounted in the through hole 51 of the holder body 50 and biased between the steel balls "R" to push the steel balls "R" outward from the through hole 51 of the holder body 50. When a socket is mounted on the holder body 50, the steel balls "R" press the inner wall of the socket to position the socket onto the holder body 50. However, the steel balls "R" increase the cost of fabrication of the conventional socket holder. In addition, it is inconvenient to assemble the steel balls "R" in the through hole 51 of the holder body 50. Further, the steel balls "R" and the spring "S" easily produce rust due to moisture. Further, the spring "S" produces an elastic fatigue during a long-term utilization, thereby failing the conventional socket holder.

BRIEF SUMMARY OF THE INVENTION

In accordance with the present invention, there is provided a socket holder comprising at least one holder body, at least one elastomer fixing device mounted in the holder body, and at least one socket mounted on the holder body and locked by the elastomer fixing device. The socket has an interior provided with a mounting hole mounted on the holder body. The mounting hole of the socket has a wall provided with at least one groove. The holder body is made of hard material. The holder body has a size matching that of the mounting hole of the socket. The elastomer fixing device is made of soft material. The elastomer fixing device has an outside provided with at least one arcuate protrusion protruding outward from the holder body and locked in the groove of the mounting hole of the socket. The arcuate protrusion of the elastomer fixing device has a shape and a size matching that of the groove of the mounting hole of the socket. The arcuate protrusion of the elastomer fixing device is deformed slightly so that the arcuate protrusion of the elastomer fixing device is allowed to enter the mounting hole of the socket.

Preferably, the elastomer fixing device is combined with the holder body in an injection pressing manner.

The holder body has a first face provided with a first recess and a second face provided with a second recess. The holder body has a central position provided with a through hole which is connected between the first recess and the second recess. The through hole, the first recess and the second recess of the holder body to receive and fix the elastomer fixing device.

Preferably, the elastomer fixing device is fixed in and combined with the through hole, the first recess and the second recess of the holder body in an injection pressing manner.

Preferably, the holder body has a side provided with a slideway mounted on a hanging rack. The slideway of the holder body has a width equal to that of the hanging rack so that the slideway of the holder body is slidable on the hanging rack. The hanging rack has a first end provided with a hanging hole and a second end provided with a stop portion.

Alternatively, the holder body is combined with a hanging plate. The hanging plate has a first end combined with the holder body and a second end provided with a hanging hole.

Preferably, the elastomer fixing device is made of polyethylene (PE).

According to the primary advantage of the present invention, the elastomer fixing device is integrally formed with the arcuate protrusion without having to provide a steel ball so as to reduce the cost of fabrication of the socket holder.

According to another advantage of the present invention, the elastomer fixing device is formed with the arcuate protrusion to replace the conventional steel ball so as to prevent from incurring a rust problem.

According to a further advantage of the present invention, the elastomer fixing device is combined with the holder body in an injection pressing manner so that the socket holder is produced and assembled easily and quickly.

According to a further advantage of the present invention, the elastomer fixing device replaces the conventional spring so as to prevent from incurring an elastic fatigue.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
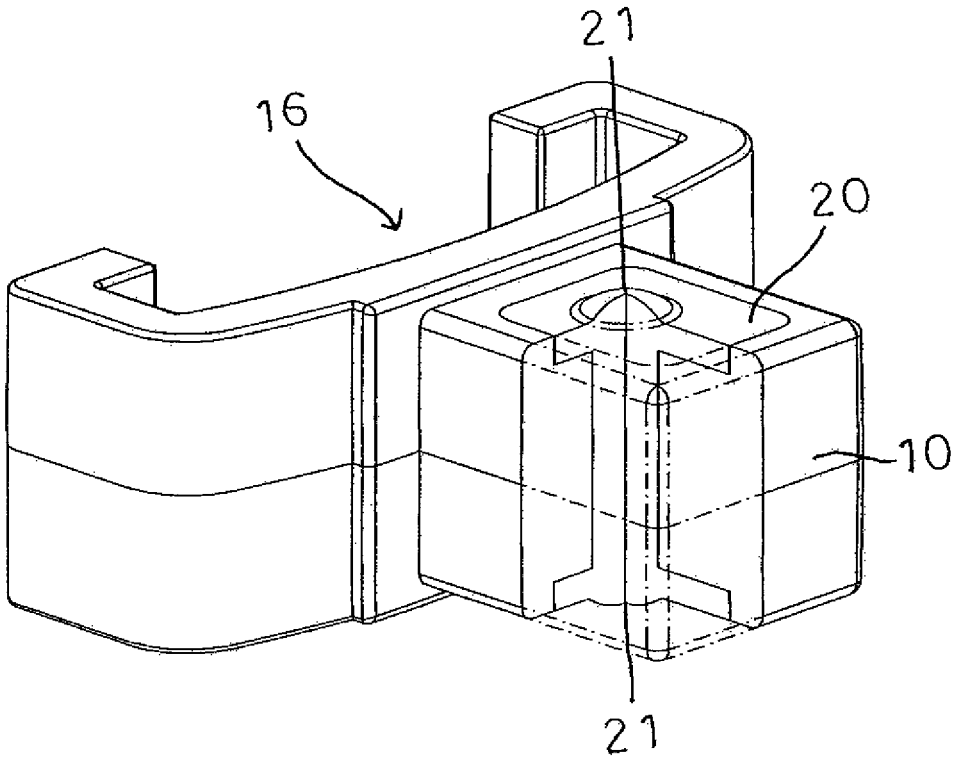
FIG. 1 is a perspective view of a socket holder in accordance with the preferred embodiment of the present invention.
Figure 2:
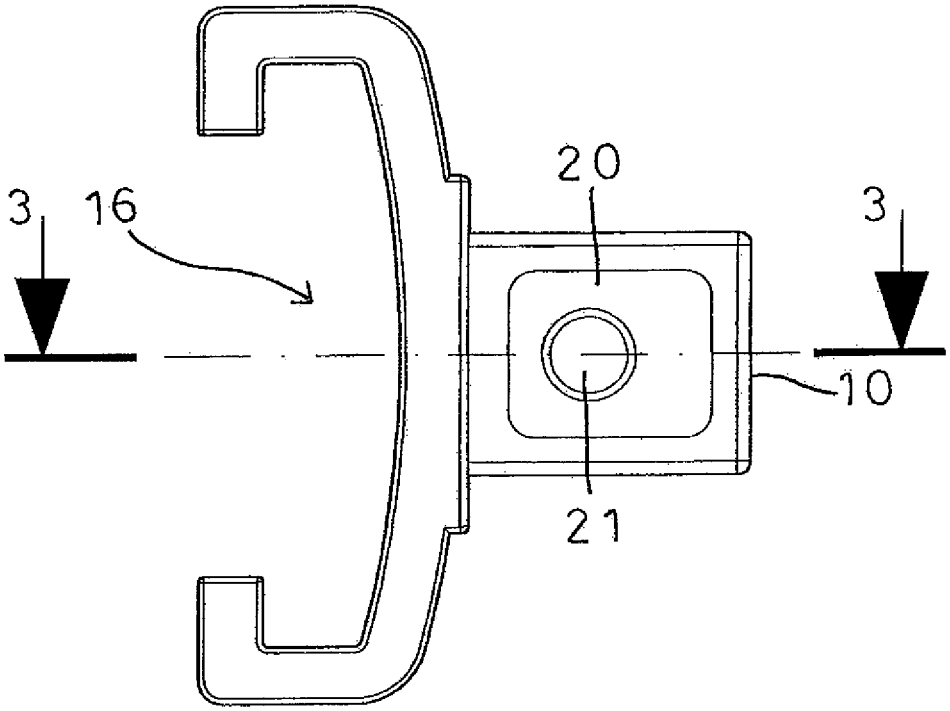
FIG. 2 is a top view of the socket holder as shown in FIG. 1.
Figure 3:
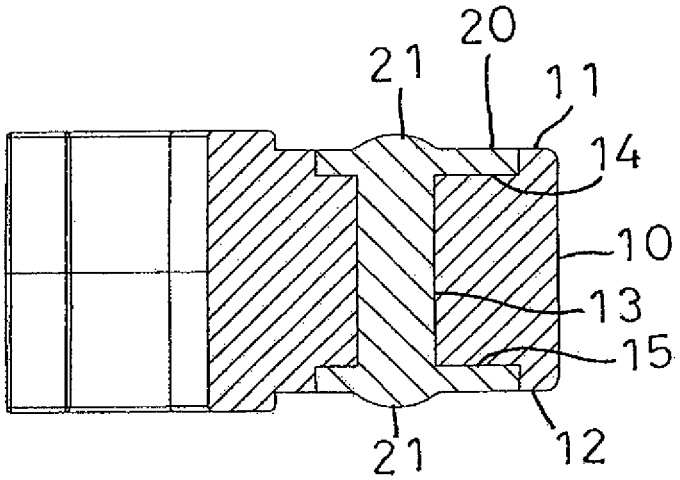
FIG. 3 is a cross-sectional view of the socket holder taken along line 3-3 as shown in FIG. 2.
Figure 4:
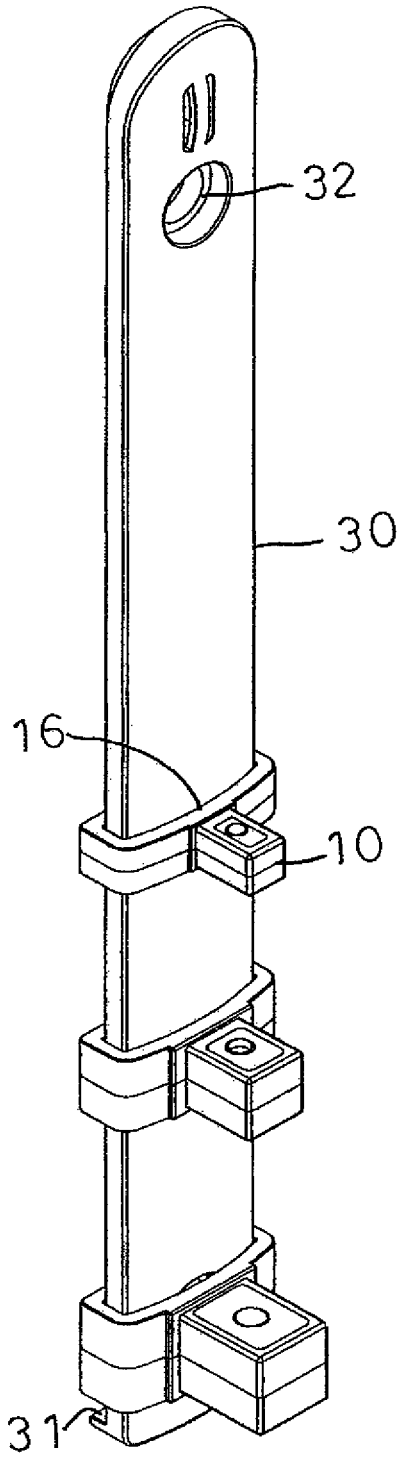
FIG. 4 is a perspective view of the socket holder for a hanging rack in accordance with the preferred embodiment of the present invention.

Referring to the drawings and initially to FIGS. 1-6, a socket holder in accordance with the preferred embodiment of the present invention comprises at least one holder body 10, at least one elastomer fixing device 20 mounted in the holder body 10, and at least one socket 1 mounted on the holder body 10 and locked by the elastomer fixing device 20.

The socket 1 has an interior provided with a mounting hole 2 mounted on the holder body 10. Preferably, the mounting hole 2 of the socket 1 has a square shape, and the holder body 10 has a square shape matching the mounting hole 2 of the socket 1. The mounting hole 2 of the socket 1 has a wall provided with at least one groove 3. Preferably, the socket 1 has two opposite grooves 3.

The holder body 10 is made of hard material. The holder body 10 has a size matching that of the mounting hole 2 of the socket 1. The holder body 10 has a first face 11 provided with a first recess 14 and a second face 12 provided with a second recess 15. The holder body 10 has a central position provided with a through hole 13 which is connected between the first recess 14 and the second recess 15. The through hole 13 of the holder body 10 has a size smaller than that of the first recess 14 and smaller than that of the second recess 15. The through hole 13, the first recess 14 and the second recess 15 of the holder body 10 to receive and fix the elastomer fixing device 20. The holder body 10 has a side provided with a slideway 16 mounted on a hanging rack 30. The slideway 16 of the holder body 10 has a width equal to that of the hanging rack 30 so that the slideway 16 of the holder body 10 is slidable on the hanging rack 30. The hanging rack 30 has a first end provided with a hanging hole 32 and a second end provided with a stop portion 31.

The elastomer fixing device, 20 is made of soft material. Preferably, the elastomer fixing device 20 is made of polyethylene (PE). The elastomer fixing device 20 has an outside provided with at least one arcuate protrusion 21 protruding outward from the holder body 10 and locked in the groove 3 of the mounting hole 2 of the socket 1. Preferably, the elastomer fixing device 20 has two opposite arcuate protrusions 21 each protruding outward from the holder body 10. The arcuate protrusion 21 of the elastomer fixing device 20 has a shape and a size matching that of the groove 3 of the mounting hole 2 of the socket 1. The arcuate protrusion 21 of the elastomer fixing device 20 is deformed slightly so that the arcuate protrusion 21 of the elastomer fixing device 20 is allowed to enter the mounting hole 2 of the socket 1. In fabrication, the elastomer fixing device 20 is combined with the holder body 10 in an injection pressing manner. Preferably, the elastomer fixing device 20 is fixed in and combined with the through hole 13, the first recess 14 and the second recess 15 of the holder body 10 in an injection pressing manner.

Figure 5:
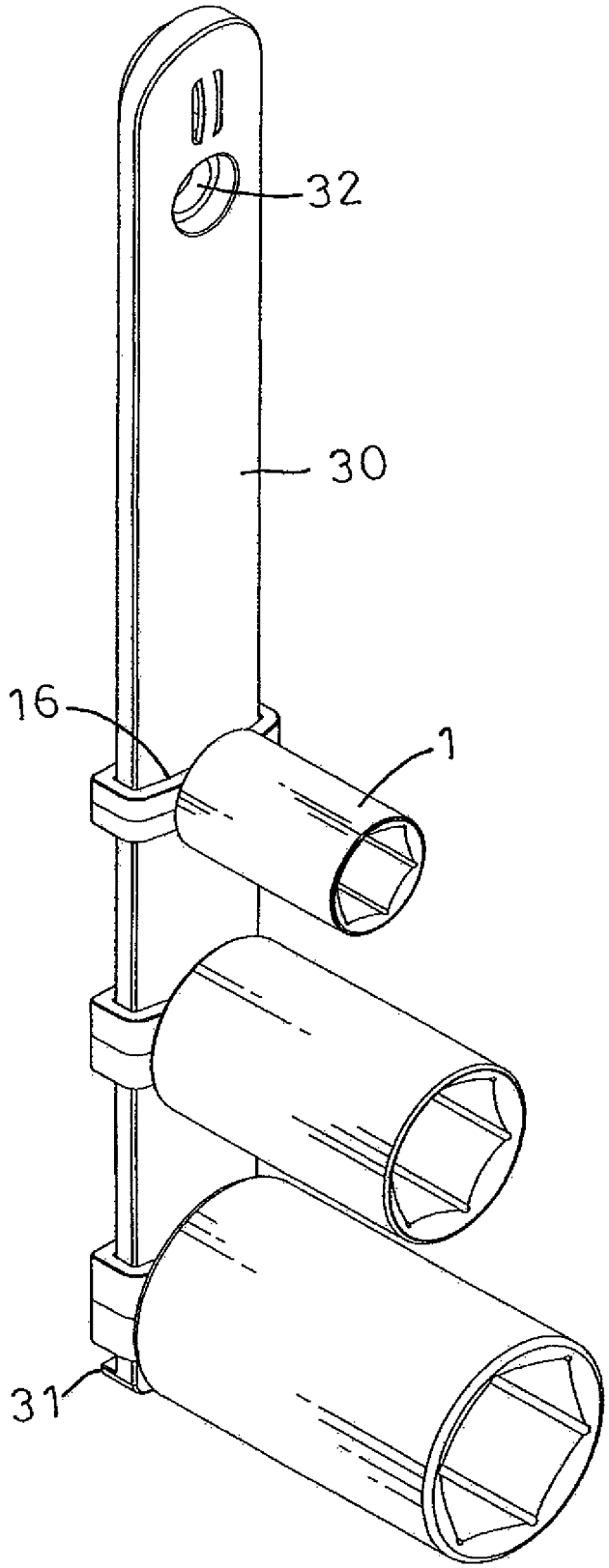
FIG. 5 is a schematic operational view of the socket holder for a socket as shown in FIG. 4 in use.
Figure 6:
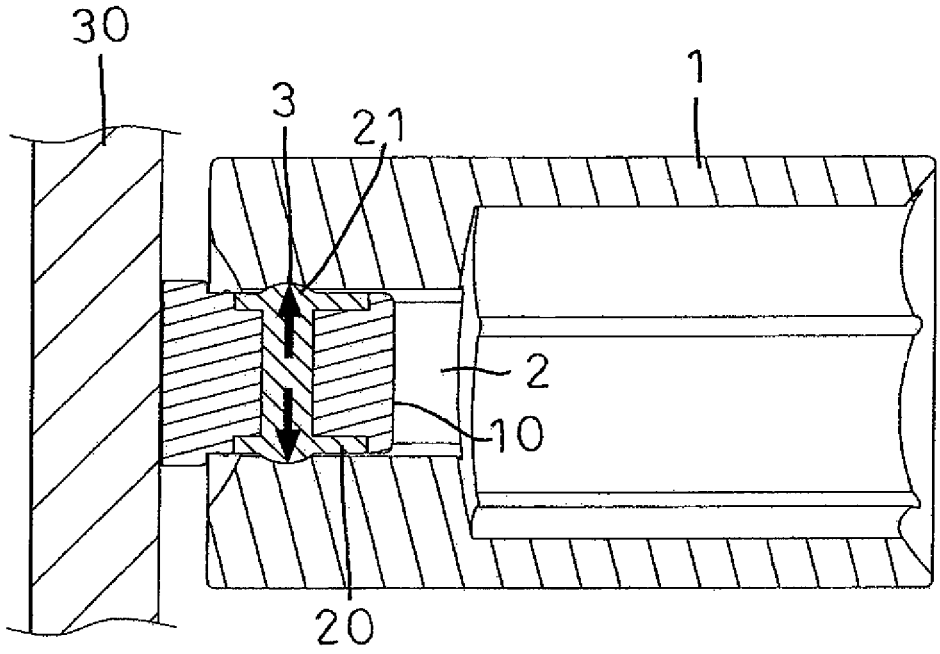
FIG. 6 is a partially cross-sectional view of the socket holder as shown in FIG. 5.
Figure 7:
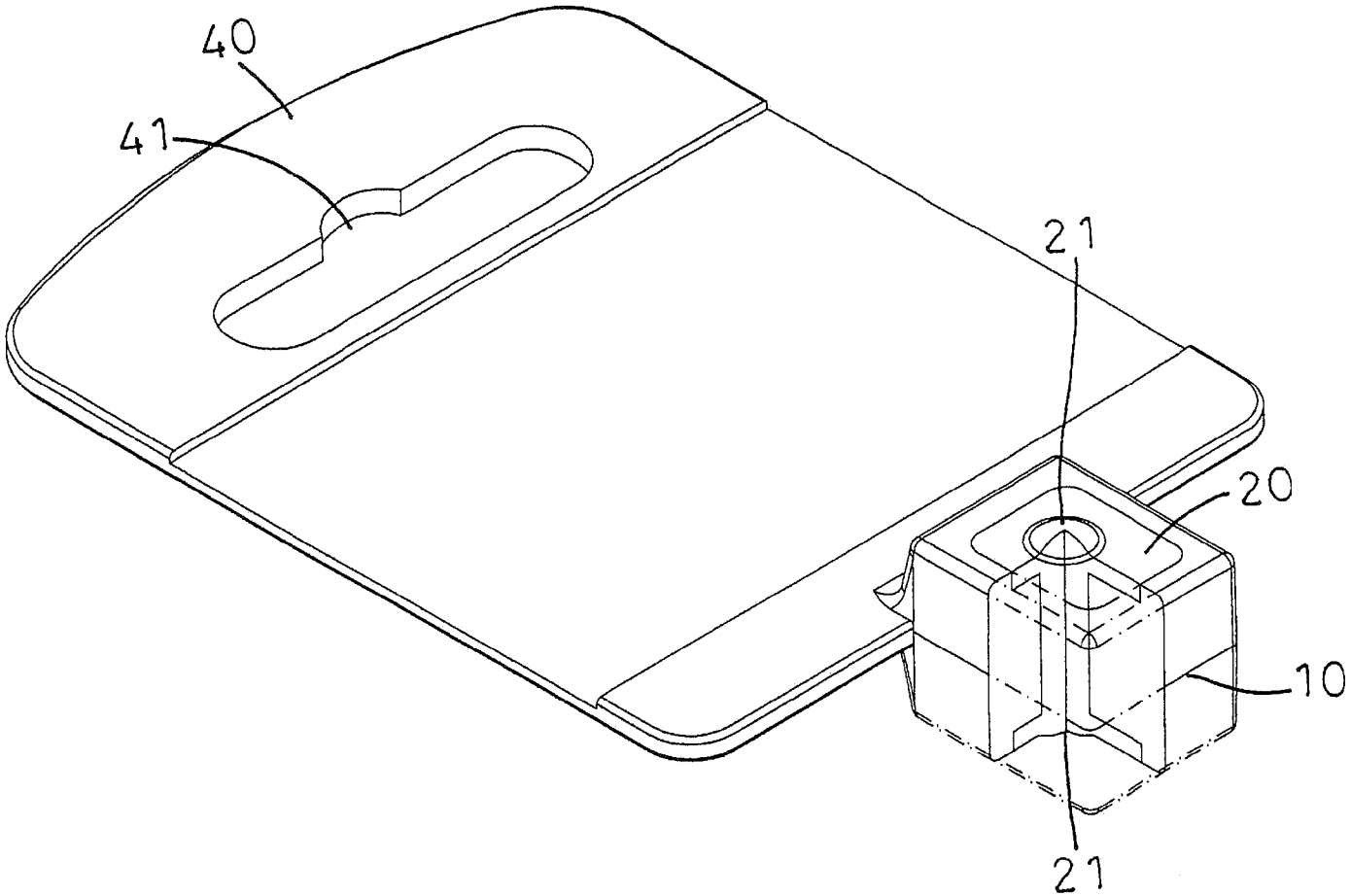
FIG. 7 is a perspective view of the socket holder for a hanging plate in accordance with another preferred embodiment of the present invention.
Figure 8:
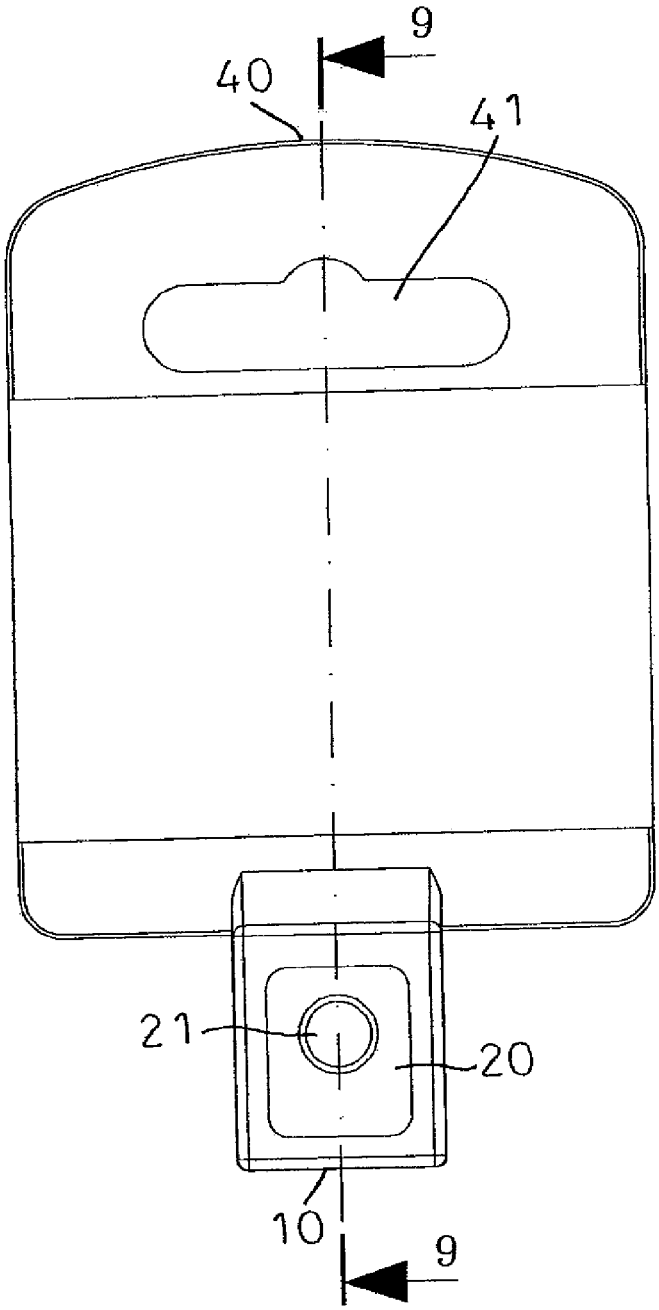
FIG. 8 is a top view of the socket holder as shown in FIG. 7.
Figure 9:
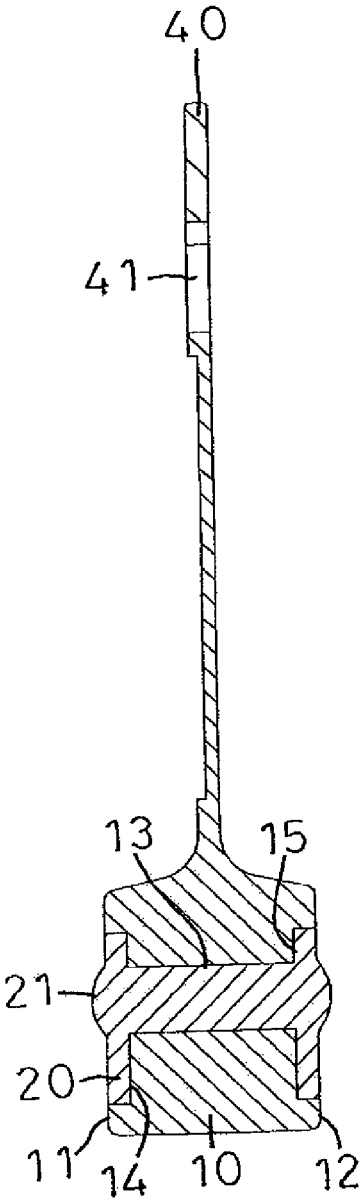
FIG. 9 is a cross-sectional view of the socket holder taken along line 9-9 as shown in FIG. 8.
Figure 10:
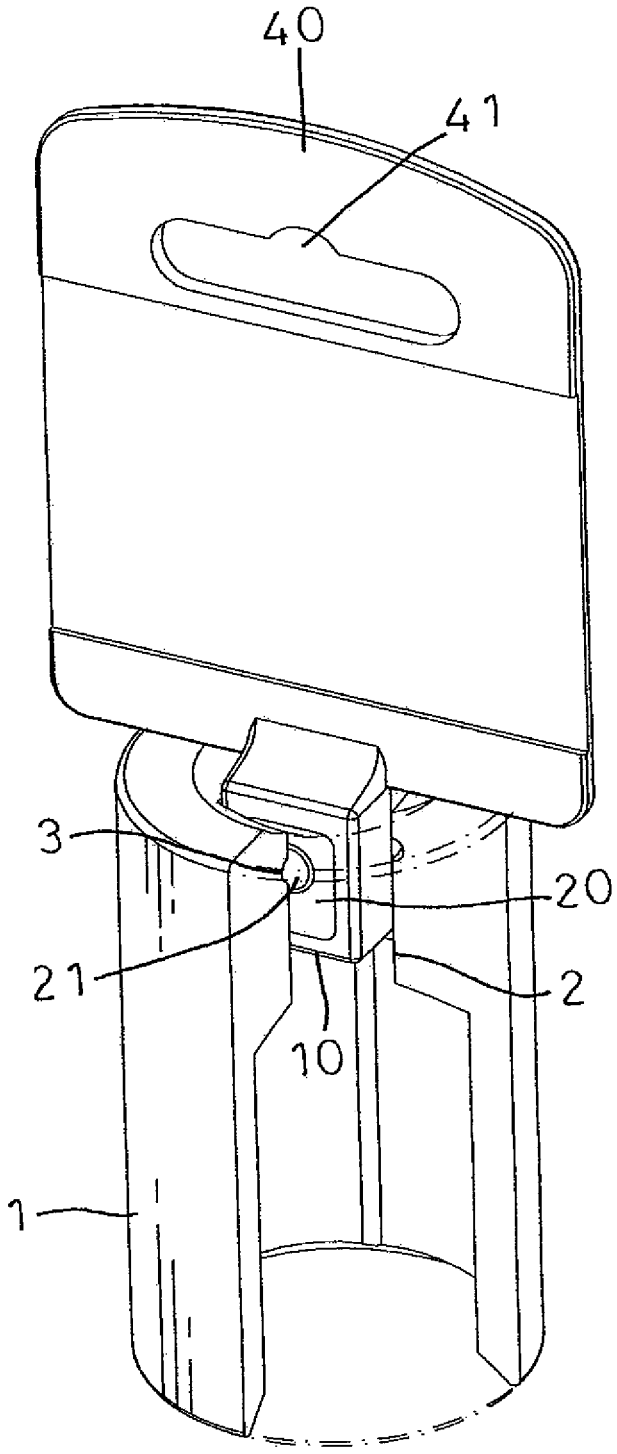
FIG. 10 is a schematic operational view of the socket holder for a socket as shown in FIG. 7 in use.

In operation, referring to FIGS. 5 and 6 with reference to FIGS. 1-4, when the mounting hole 2 of the socket 1 is mounted on the holder body 10 and abuts the elastomer fixing device 20, the arcuate protrusion 21 of the elastomer fixing device 20 is pressed by the mounting hole 2 of the socket 1 and is deformed and contracted slightly so that the arcuate protrusion 21 of the elastomer fixing device 20 is allowed to enter the mounting hole 2 of the socket 1. When the arcuate protrusion 21 of the elastomer fixing device 20 aligns with the groove 3 of the mounting hole 2 of the socket 1, the arcuate protrusion 21 of the elastomer fixing device 20 is expanded outward by its elasticity as shown in FIG. 6, so that the arcuate protrusion 21 of the elastomer fixing device 20 is inserted into and locked in the groove 3 of the mounting hole 2 of the socket 1, and the socket 1 is locked onto the holder body 10 by the elastomer fixing device 20.

Referring to FIGS. 7-12, the holder body 10 is combined with a hanging plate 40. The hanging plate 40 has a first end combined with the holder body 10 and a second end provided with a hanging hole 41.

Figure 11:
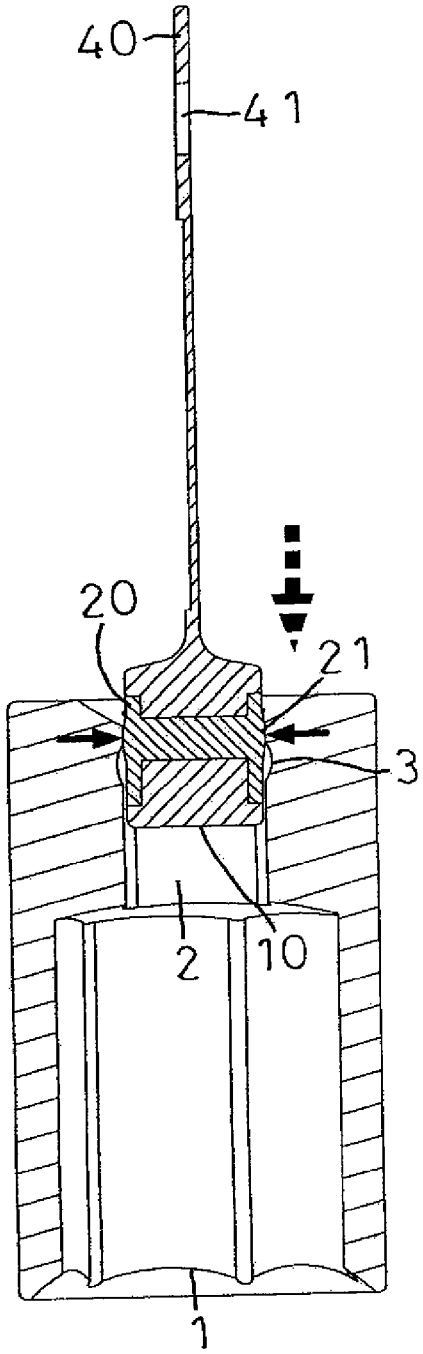
FIG. 11 is a schematic operational view showing the socket being mounted onto the holder body.
Figure 12:
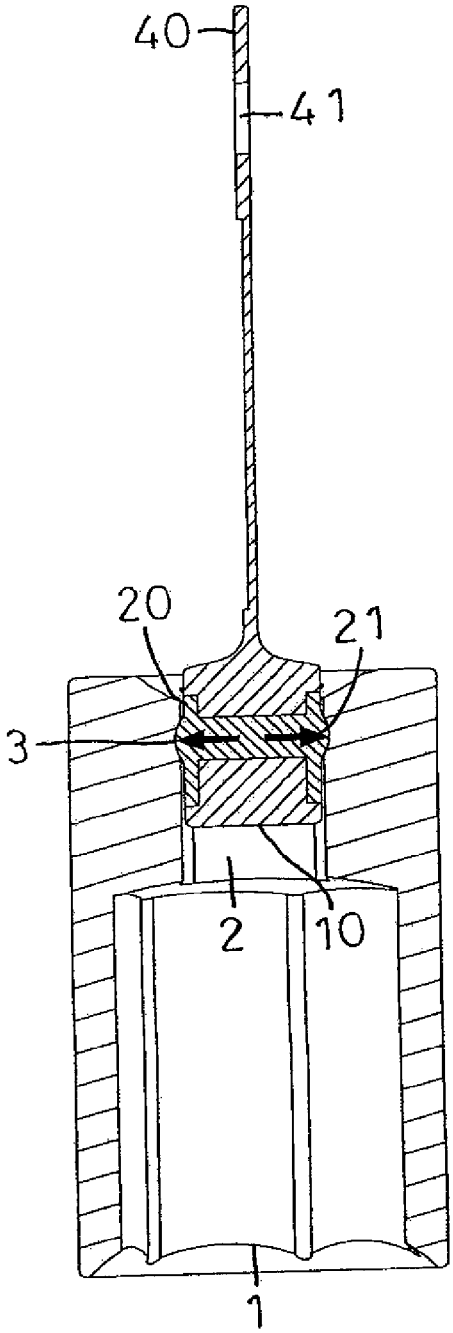
FIG. 12 is a schematic operational view showing the socket being locked onto the holder body.
Figure 13:
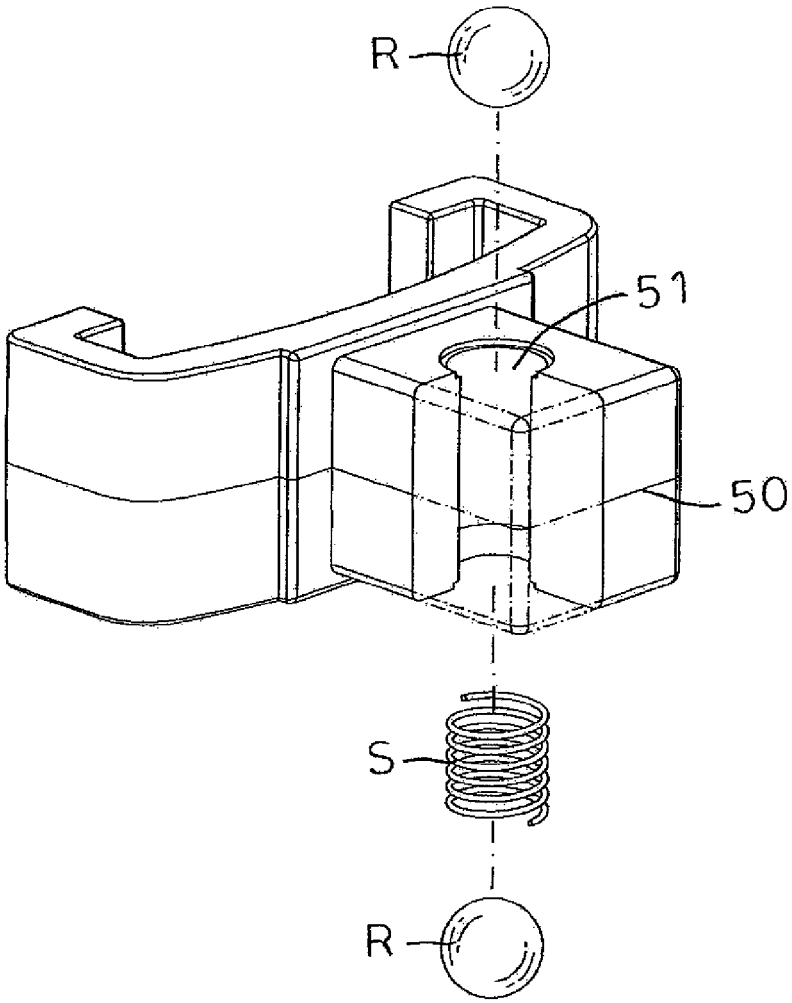
FIG. 13 PRIOR ART
FIG. 13 is an exploded perspective view of a conventional socket holder in accordance with the prior art.
Figure 14:
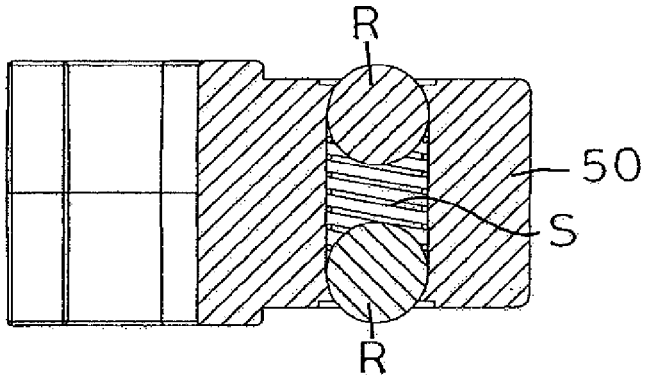
FIG. 14 PRIOR ART
FIG. 14 is a cross-sectional assembly view of the conventional socket holder as shown in FIG. 13.

In operation, referring to FIGS. 11 and 12 with reference to FIGS. 7-10, when the mounting hole 2 of the socket 1 is mounted on the holder body 10 and abuts the elastomer fixing device 20, the arcuate protrusion 21 of the elastomer fixing device 20 is pressed by the mounting hole 2 of the socket 1 and is deformed and contracted slightly so that the arcuate protrusion 21 of the elastomer fixing device 20 is allowed to enter the mounting hole 2 of the socket 1 as shown in FIG. 11. When the arcuate protrusion 21 of the elastomer fixing device 20 aligns with the groove 3 of the mounting hole 2 of the socket 1, the arcuate protrusion 21 of the elastomer fixing device 20 is expanded outward by its elasticity as shown in FIG. 12, so that the arcuate protrusion 21 of the elastomer fixing device 20 is inserted into and locked in the groove 3 of the mounting hole 2 of the socket 1, and the socket 1 is locked onto the holder body 10 by the elastomer fixing device 20.

Accordingly, the elastomer fixing device 20 is integrally formed with the arcuate protrusion 21 without having to provide a steel ball so as to reduce the cost of fabrication of the socket holder. In addition, the elastomer fixing device 20 is formed with the arcuate protrusion 21 to replace the conventional steel ball so as to prevent from incurring a rust problem. Further, the elastomer fixing device 20 is combined with the holder body 10 in an injection pressing manner so that the socket holder is produced and assembled easily and quickly. Further, the elastomer fixing device 20 replaces the conventional spring so as to prevent from incurring an elastic fatigue.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A socket holder comprising:

at least one holder body;

at least one elastomer fixing device mounted in the at least one holder body; and at least one socket mounted on the at least one holder body and locked by the at least one elastomer fixing device; wherein:

the at least one socket has an interior provided with a mounting hole mounted on the at least one holder body;

the mounting hole of the at least one socket has a wall provided with at least one groove;

the at least one holder body is made of hard material;

the at least one holder body has a size matching that of the mounting hole of the at least one socket;

the at least one elastomer fixing device is made of soft material;

the at least one elastomer fixing device has an outside provided with at least one arcuate protrusion protruding outward from the at least one holder body and locked in the at least one groove of the mounting hole of the at least one socket;

the at least one elastomer fixing device is fixed in and combined with the at least one holder body in an injection pressing manner;

the at least one arcuate protrusion is elastic;

the at least one arcuate protrusion of the at least one elastomer fixing device has a shape and a size matching that of the at least one groove of the mounting hole of the at least one socket; and the at least one arcuate protrusion of the at least one elastomer fixing device is deformed slightly so that the at least one arcuate protrusion of the at least one elastomer fixing device is allowed to enter the mounting hole of the at least one socket.

2. The socket holder of claim 1, wherein:

the at least one holder body has a first face provided with a first recess and a second face provided with a second recess;

the at least one holder body has a central position provided with a through hole which is located and connected between the first recess and the second recess;

the at least one elastomer fixing device is combined with the through hole, the first recess and the second recess of the at least one holder body; and the through hole, the first recess and the second recess of the at least one holder body to receive and fix the at least one elastomer fixing device.

3. The socket holder of claim 1, wherein:

the at least one holder body has a side provided with a slideway mounted on a hanging rack;

the slideway of the at least one holder body has a width equal to that of the hanging rack so that the slideway of the at least one holder body is slidable on the hanging rack; and the hanging rack has a first end provided with a hanging hole and a second end provided with a stop portion.

4. The socket holder of claim 1, wherein:

the at least one holder body is combined with a hanging plate; and the hanging plate has a first end combined with the at least one holder body and a second end provided with a hanging hole.

5. The socket holder of claim 1, wherein the at least one elastomer fixing device is made of polyethylene (PE).

* * * * *